US009019160B2

(12) United States Patent
Sharawi et al.

(10) Patent No.: US 9,019,160 B2
(45) Date of Patent: Apr. 28, 2015

(54) CSRR-LOADED MIMO ANTENNA SYSTEMS

(71) Applicant: King Fahd University of Petroleum and Minerals, Dhahran (SA)

(72) Inventors: Mohammad S. Sharawi, Dhahran (SA); Muhammad Umar Khan, Dhahran (SA); Ahmad Bilal Numan, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 254 days.

(21) Appl. No.: 13/846,841

(22) Filed: Mar. 18, 2013

(65) Prior Publication Data

US 2014/0266974 A1 Sep. 18, 2014

(51) Int. Cl.
*H01Q 1/38* (2006.01)
*H01Q 21/28* (2006.01)

(52) U.S. Cl.
CPC ..... *H01Q 21/28* (2013.01)

(58) Field of Classification Search
USPC ..... 343/700 MS, 893; 333/202, 205
See application file for complete search history.

(56) References Cited

U.S. PATENT DOCUMENTS

2001/0038325 A1* 11/2001 Smith et al. ..... 333/202
2007/0024399 A1* 2/2007 Martin Antolin et al. .... 333/205
2010/0283687 A1* 11/2010 Ehelen ..... 343/700 MS
2011/0260946 A1 10/2011 Dandekar et al.
2012/0223869 A1 9/2012 Kim et al.

FOREIGN PATENT DOCUMENTS

CN 101388489 A 3/2009

* cited by examiner

*Primary Examiner* — Tan Ho
(74) *Attorney, Agent, or Firm* — Richard C Litman

(57) ABSTRACT

The CSRR-loaded MIMO antenna systems provide highly compact designs for multiple-input-multiple-output (MIMO) antennas for use in wireless mobile devices. Exemplary two element (2×1), and four element (2×2) MIMO antenna systems are disclosed in which complementary split-ring resonators load patch antennas elements. The overall dimensions of the exemplary MIMO antenna system designed for operation from 750 MHz to 6 GHz band remain within 100×50×0.8 $mm^2$.

11 Claims, 6 Drawing Sheets

CSRR-LOADED MIMO ANTENNA SYSTEMS

BACKGROUND OF THE INVENTION

1. Field of the Invention

The present invention relates to multiple-input-multiple-output (MIMO) antenna systems, and particularly to complementary split ring resonator (CSRR)-loaded MIMO antenna systems, which provide compact antennas for radio frequency-based applications, including 4G cellular systems.

2. Description of the Related Art

The fourth generation (4G) wireless standards are made to meet the demands of high data rates required by current and future wireless services. Multi-input-multi-output (MIMO) antenna systems are an enabling technology that achieves high data rates in wireless mobile devices using wireless services.

MIMO antenna systems are made up by combining multiple antennas in the transmitter and receiver terminals of the wireless system. Although easier to implement at the transmitter side, which normally does not have strict limitation of size, the design of MIMO antenna systems at the receiver end (i.e., the user handheld terminals) is really challenging. This is due to the fact that most receivers are compact mobile devices with strict limitations on the size of the antenna. Due to these limitations, novel miniaturized antenna element designs are required.

To get good diversity performance of a MIMO antenna, it is necessary that the antenna elements be uncorrelated. This becomes a serious issue when the antenna elements are placed close to each other due to the size limitation of the MIMO antenna.

Thus, CSRR-loaded MIMO antenna systems solving the aforementioned problems are desired.

SUMMARY OF THE INVENTION

The CSRR-loaded MIMO antenna systems provide highly compact designs for multiple-input-multiple-output (MIMO) antennas used in wireless mobile devices. Exemplary two-element (2×1), and four-element (2×2) MIMO antenna systems are disclosed in which complementary split-ring resonators load patch antenna elements. The overall dimensions of the exemplary MIMO antenna system designed for operation from 750 MHz to 6 GHz band remain within 100×50×0.8 $mm^2$.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The CSRR-loaded MIMO antenna systems provide highly compact designs for multiple-input-multiple-output (MIMO) antennas used in wireless mobile devices. Exemplary two-element (2×1), and four-element (2×2) MIMO antenna systems are disclosed in which complementary split-ring resonators load patch antennas elements. The overall dimensions of the exemplary MIMO antenna system designed for operation from 750 MHz to 6 GHz band remain within 100×50×0.8 $mm^2$.

An exemplary highly compact MIMO antenna system fits within a standard handheld mobile device. At least two antenna elements can be implemented in the MIMO antenna system for the lower bands, and up to ten or more elements can be implemented for the higher bands. All antenna systems are designed on a PCB (printed circuit board) made from an FR-4 substrate with relative permittivity of 4.4 and thickness of 0.8 mm. FR-4 is a composite material composed of woven fiberglass cloth with an epoxy resin binder that is flame-resistant. The present designs can also be made on any other substrate. However, that will change the dimensions of the designs. Both the designs are based on the use of patch antennas separated by a reasonable spacing as the elements of MIMO antenna system. All patch antennas are loaded with complementary split-ring resonators (CSRR) for antenna miniaturization. The CSRR-loaded patch allows for antenna size miniaturization of at least 75% compared to a regular patch size. The CSRR has a structure that is shown to exhibit meta-material properties around its frequency of resonance. It is made by cutting a conducting sheet (usually the ground plane) in the shape of split-ring resonators (SRR). The SRR has two concentric rings, having a split in each ring. The two rings have spacing between them, and the slits of the two rings are in opposing directions with respect to each other.

Figure 1:
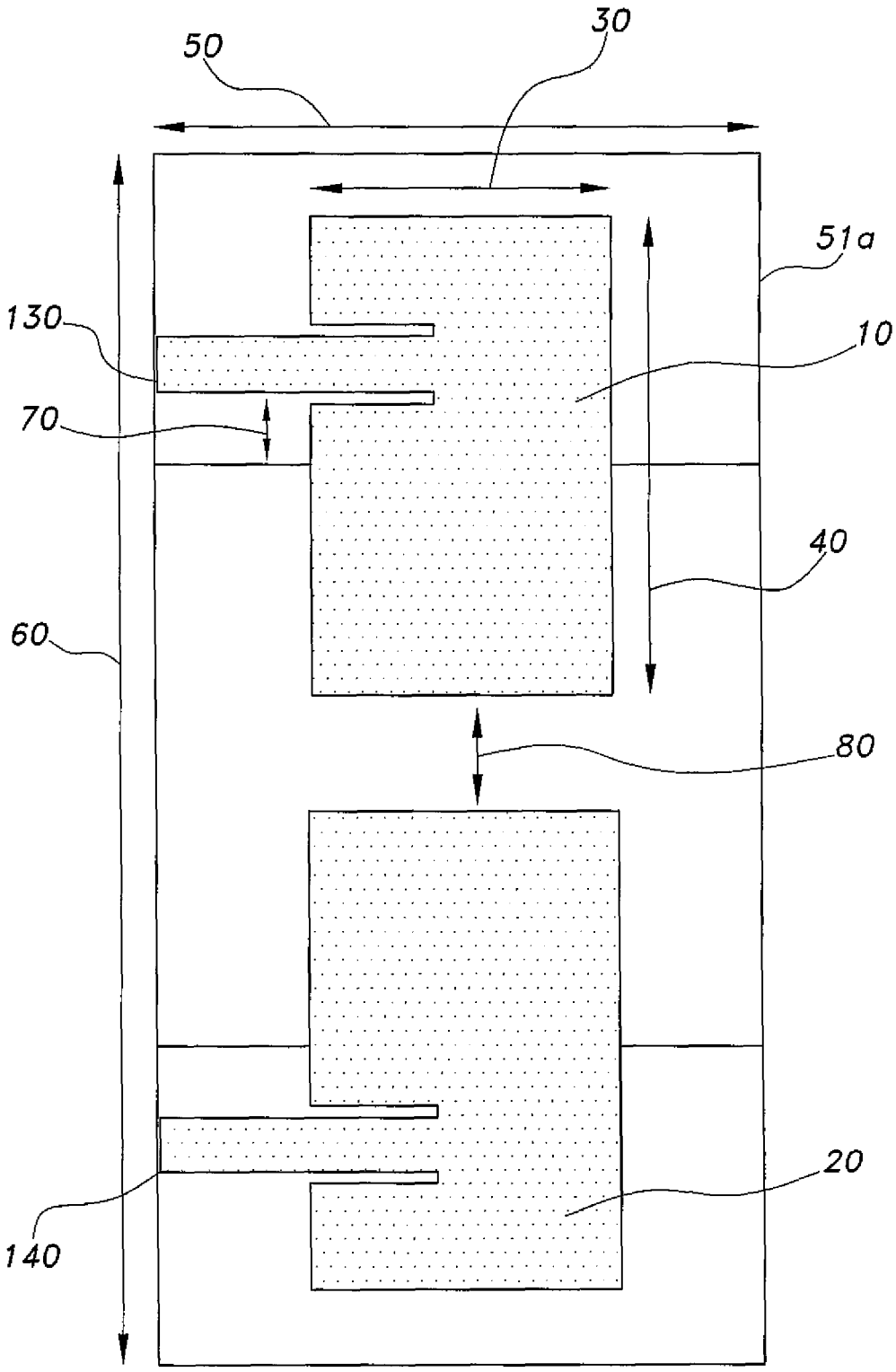
FIG. 1 is a top plan view of an exemplary CSRR-loaded MIMO antenna system according to the present invention.

FIG. 1 shows a top plan view of an exemplary two-element (2×1) MIMO antenna system. This antenna is designed to operate in the lower band of 750 MHz. Identical patch antenna elements 10 and 20 are separated by a predetermined distance 80. The substantially rectangular patch elements 10 and 20 are disposed on top portion 51*a* of the FR-4 substrate, and each element 10, 20 has a predetermined length 30 and a predetermined width 40. The PCB board has an overall width 50 and an overall length 60. Preferably, the overall width 50 is 50 mm and the overall length 60 is 100 mm. Substantially rectangular microstrip transmission lines 130 and 140 extend from the patch elements 10 and 20, respectively, and function as feedlines for the elements 10 and 20. These feeding microstrip transmission lines 130 and 140 are designed to match a 50Ω impedance. For each patch antenna 10, 20, the feeding microstrip transmission line 130, 140 of the patch element is shifted off-center (offset) from a center line along the width 40 of the patch antenna by a shifting distance 70 for proper mode excitation.

Figure 2:
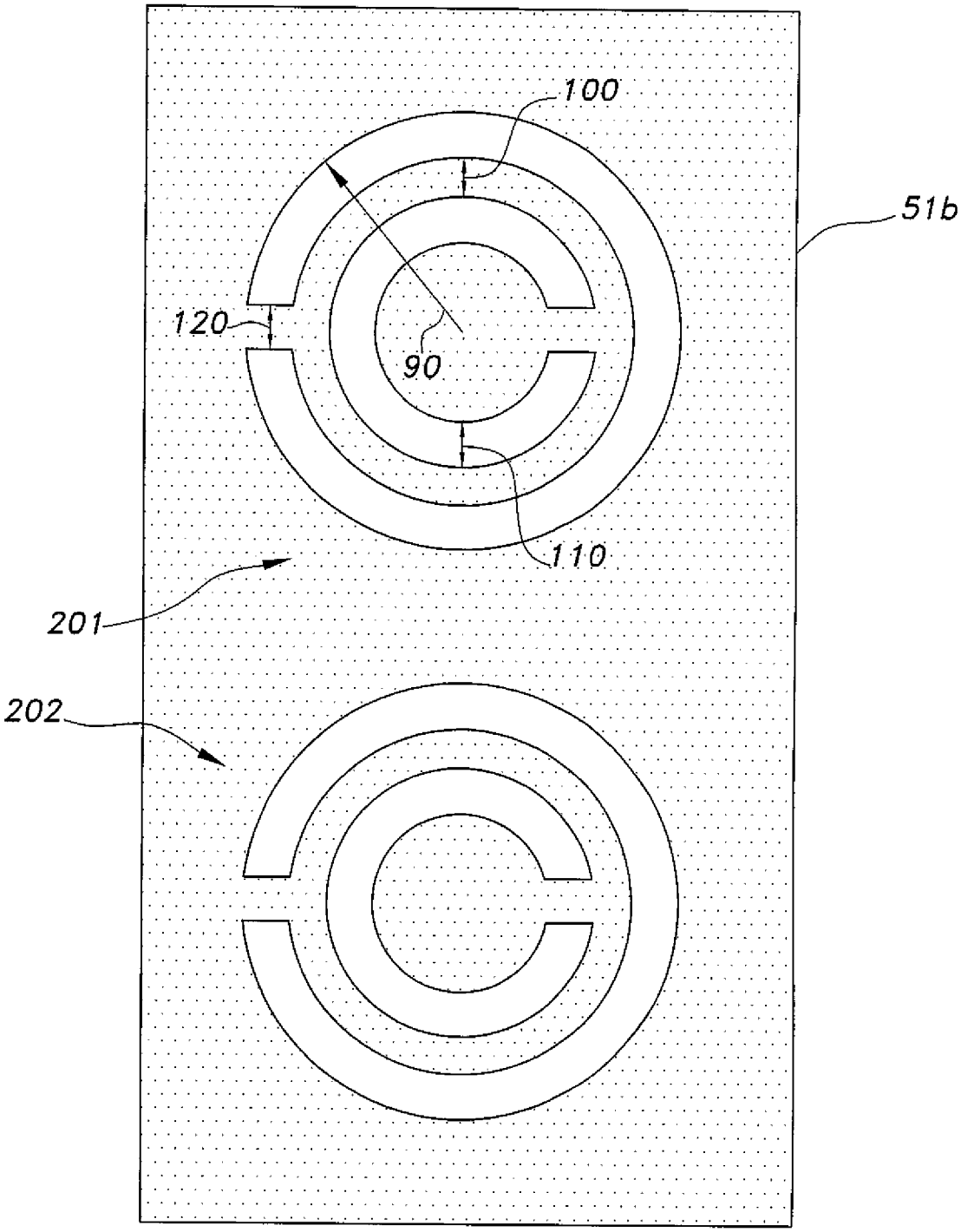
FIG. 2 is a bottom plan view of the CSRR-loaded MIMO antenna system of FIG. 1.

FIG. 2 shows the bottom side of the two-element MIMO antenna. It comprises a copper ground plane 51*b* having two CSRRs 201 and 202 etched therein (i.e., there is no copper in the etched areas) underneath the patch elements. Each CSRR 201, 202 is centered at the middle of patches 10 and 20 on the opposite side 51*a* shown in FIG. 1. The radius 90 of the outer ring of each resonator 201, 202 is a predetermined design factor. The width 110 of each ring in a given resonator is a predetermined design factor, and the ring spacing 100 between the two rings in a given resonator is also a predetermined design factor. The slit width 120 in each ring is an additional predetermined design factor. These design factors are parameters that are determined by the antenna designer according to the desired resonance. The outer ring slit is disposed in angular alignment with the microstrip transmission line on the other side of the PCB.

The MIMO antenna of FIGS. 1-2 was designed to operate in the 750 MHz LTE band. For that resonant frequency, the dimensions of the patch elements were 30×38 $mm^2$. Elements 10 and 20 were separated by a distance of 10 mm without affecting the overall dimensions of the MIMO antenna system. The overall radius of the CSRR for this design is 11.5 mm.

Figure 3:
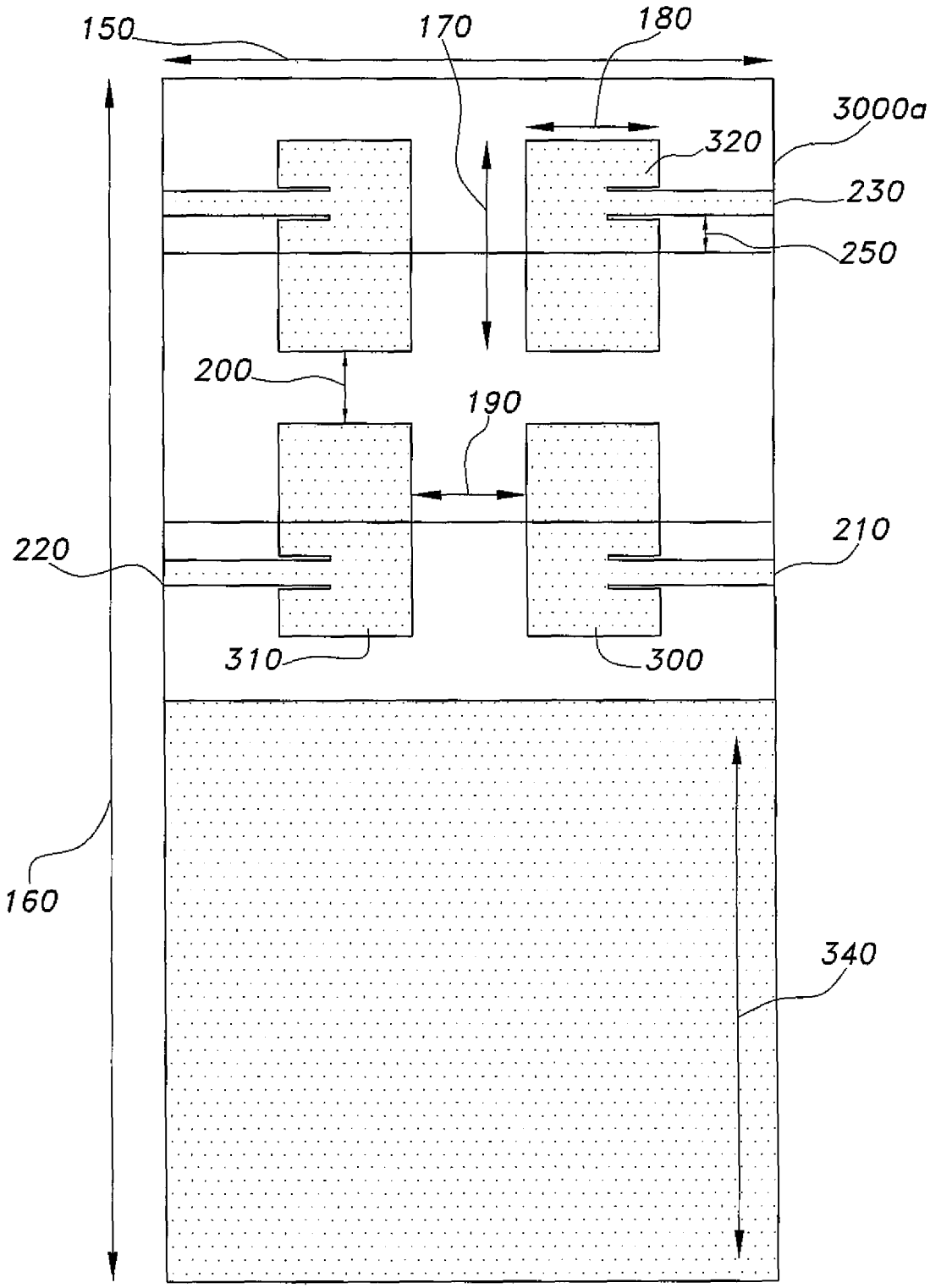
FIG. 3 is a top plan view of an alternative embodiment of a CSRR-loaded MIMO antenna system according to the present invention.

FIG. 3 shows the top plan view of an exemplary four-element (2×2) MIMO antenna system. The top side 3000*a* of the printed circuit board includes four patch elements 300, 310, 320, and 330. The antenna elements are spaced apart with a left-right spacing 190 and an upper-lower spacing 200. The four patch antenna elements are identical (300, 310 and 320, 330 being laid out as mirror images of each other) in width 170 and length 180. The patch antenna elements are fed from feeder microstrip transmission lines 210, 220, 230 and 240, and the transmission lines are matched to a 50Ω impedance. Each microstrip transmission line feeding its respective patch is offset a shifting distance 25 along the width of the patch from a center line of the patch. An additional area underneath the antenna elements (but on the top face of the PCB) is left as a ground plane having a predetermined ground plane length 340. This additional area can be used by other electronic components accompanying the antenna in a practical application. The overall width and length of the MIMO antenna system is shown by overall width 150 and overall length 160, respectively.

Figure 4:
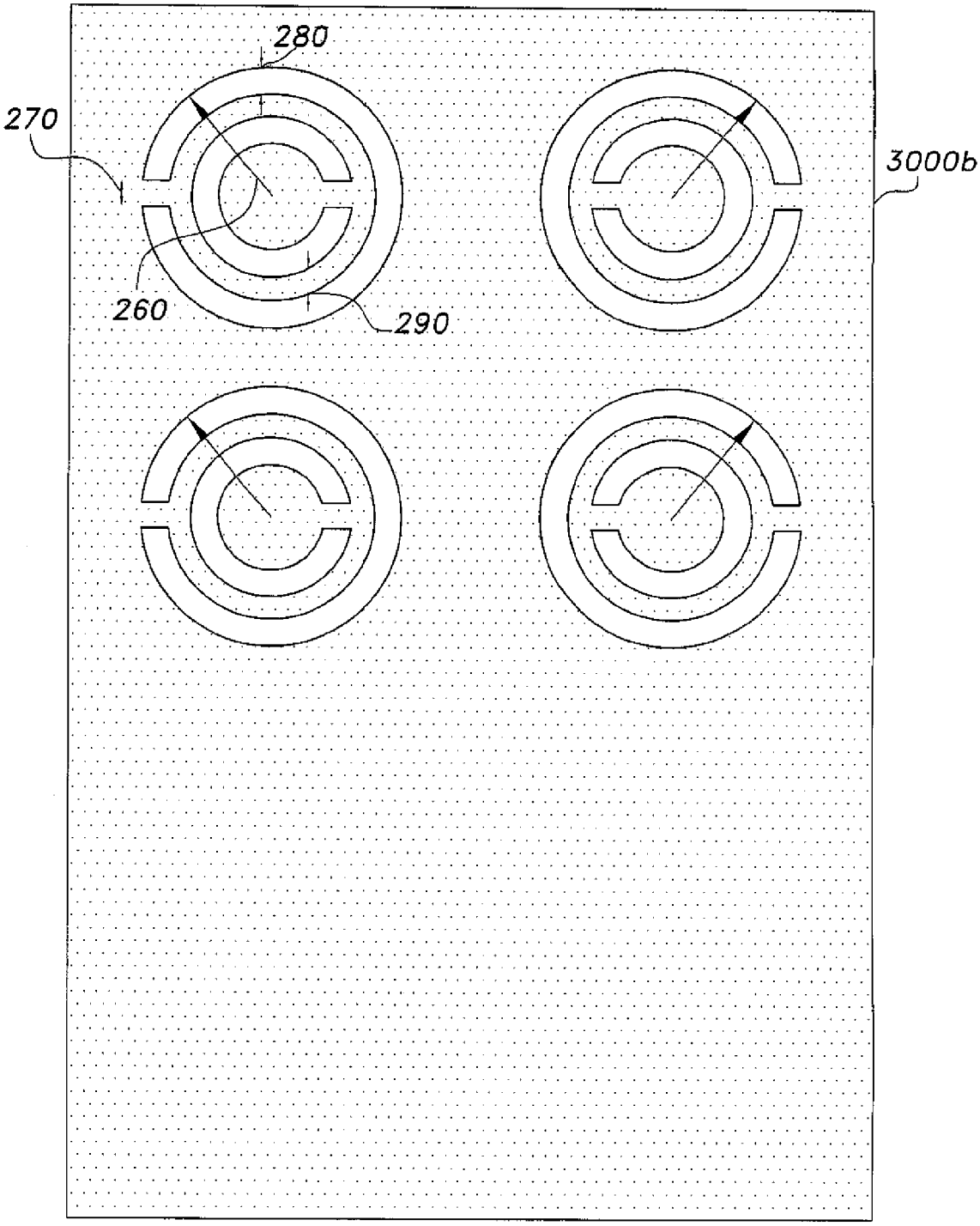
FIG. 4 is a bottom plan view of the CSRR-loaded MIMO antenna system of FIG. 3.

FIG. 4 shows the bottom face 3000*b* of the four-element MIMO antenna. Disposed on the bottom surface ground plane 3000*b*, underneath each patch, is a corresponding CSRR etched out therefrom. Each CSRR on the bottom surface ground plane 3000*b* is centered under the middle of its corresponding top surface patch, shown in FIG. 3. The radius 260 of the outer ring of each resonator is a predetermined design factor. The ring width 280 of each ring in the resonators is a predetermined design factor. The ring spacing 290 between the two rings in a single resonator is also a predetermined design factor. The slit width 270 in each ring is another predetermined design factor. These design factor parameters are selected according to the desired resonance of the system.

Figure 5:
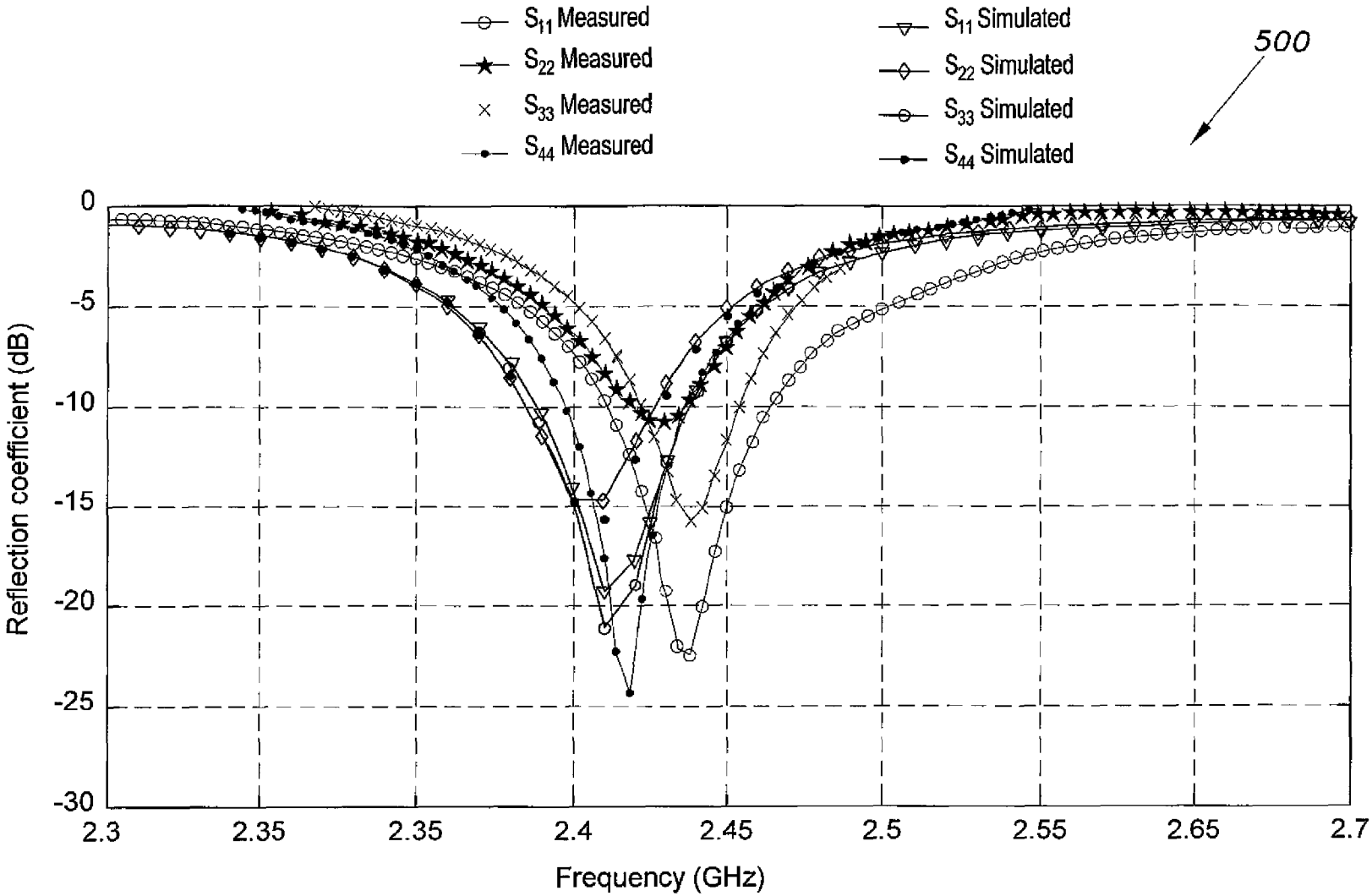
FIG. 5 is a reflection coefficient plot of an exemplary CSRR-loaded MIMO antenna system according to the present invention.
Figure 6:
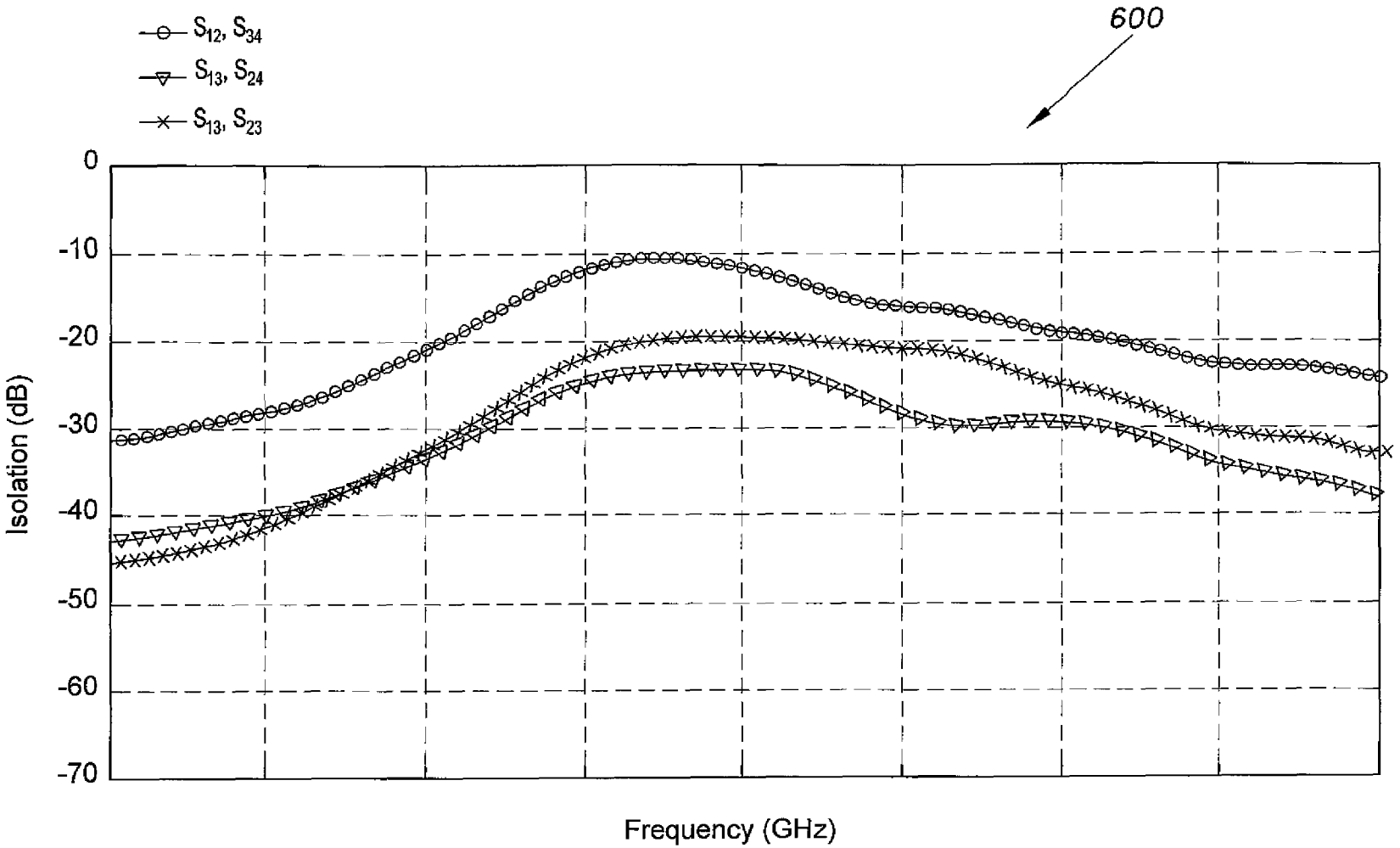
FIG. 6 is an isolation plot of an exemplary CSRR-loaded MIMO antenna system according to the present invention.

The four-element MIMO antenna of FIGS. 3-4 was designed for two different bands. In the first scheme, it was designed to operate at 2.45 GHz in the ISM band. The dimensions of each patch element are 14×18 $mm^2$, while the shift 250 in the microstrip transmission feed line is 4 mm. The spacing between the antenna elements is kept at 10 mm. Underneath the patch element, the radius 260 of the outer ring of the CSRR is 6 mm, the width 280 of the rings is 0.5 mm, and the spacing 290 between the rings is also 0.5 mm. The width 270 of the slit in the ring is 0.5 mm. The antenna was simulated in software and then fabricated. The simulation results and measured results of the reflection coefficient of each antenna element of the four-element MIMO antenna system are shown as plot 500 in FIG. 5. The measured isolation for the same design is shown as plot 600 in FIG. 6. The 3D gain patterns of the MIMO antenna system were obtained through the simulation software. The gain pattern of antenna elements 300 and 310 were identical. Similarly, the gain pattern of antenna elements 320 and 330 were identical.

In yet another embodiment, a four-element MIMO antenna system was designed to operate at 5 GHz with patch elements of dimensions 14×11 $mm^2$. The spacing between the antenna elements was kept as 5 mm. The total radius of the CSRR for this design was 2.5 mm. The frequency of operation can easily be tuned for much higher frequencies than 6 GHz.

It is to be understood that the present invention is not limited to the embodiments described above, but encompasses any and all embodiments within the scope of the following claims.

We claim:

1. A CSRR(complementary split-ring resonators)-loaded MIMO antenna system, comprising a printed circuit board (PCB) having:

at least one pair of patch antenna elements on an upper substrate surface of the PCB, the patch antenna elements being co-aligned lengthwise in mirror-image fashion, each of the patch antenna elements being a substantially rectangular planar conductor having a substantially rectangular planar microstrip transmission line extending parallel to but offset from a centerline of the rectangular planar conductor towards an edge of the PCB;

a ground plane disposed on a lower substrate surface of the PCB; and a plurality of complementary split-ring resonators (CSRRs) defined in the ground plane, each of the patch antenna elements having a corresponding one of the CSSRs centered directly beneath the patch antenna element, each of the resonators being concentric inner and outer split rings.

2. The CSRR-loaded MIMO antenna system according to claim 1, wherein in each said resonator, the outer ring has the split defined therein 180° opposite the split defined in the inner ring.

3. The CSRR-loaded MIMO antenna system according to claim 1, wherein the split in the outer ring of each said resonator extends parallel to the microstrip transmission line of the corresponding patch antenna element directly above said resonator.

4. The CSRR-loaded MIMO antenna system according to claim 1, wherein:

in each said resonator, the outer ring has the split defined therein 180° opposite the split defined in the inner ring; and the split in the outer ring of each said resonator extends parallel to the microstrip transmission line of the corresponding patch antenna element directly above said resonator.

5. The CSRR-loaded MIMO antenna system according to claim 1, wherein said at least one pair of patch antenna elements consists of a single pair of patch antenna elements, the transmission lines of the patch antenna elements extending to the same edge of the PCB.

6. The CSRR-loaded MIMO antenna system according to claim 1, wherein said microstrip transmission lines are matched to an impedance of 50Ω.

7. The CSRR-loaded MIMO antenna system according to claim 1, wherein said PCB substrate is an FR-4 material having relative permittivity of about 4.4 and thickness of about 0.8 mm.

8. The CSRR-loaded MIMO antenna system according to claim 7, wherein said at least one pair of patch antenna elements consists of a two pairs of patch antenna elements, the transmission lines of one of the pairs of the patch antenna elements extending to a first edge of the PCB, the transmission lines of the other pair of the patch antenna elements extending to a second edge of the PCB 180° opposite the first edge, the two pairs of the patch antenna elements being disposed as symmetrical mirror images of each other on the PCB.

9. The CSRR-loaded MIMO antenna system according to claim 8, wherein:

each said patch antenna element has dimensions of about $14\times18$ mm$^2$;

said patch antenna elements in each of the pairs has a centerline displacement of the microstrip transmission lines of about 4 mm;

spacing between each said patch antenna elements in each of the pairs is about 10 mm;

radii of the outer rings of said resonators is about 6 mm;

each of the rings in said resonators has a strip width of about 0.5 mm;

spacing between the inner and outer rings of each said resonator is about 0.5 mm; and the splits in each said ring have a width of about 0.5 mm;

whereby the CSRR-loaded MIMO antenna system is tuned for operation at about 2.45 GHz in the ISM band.

10. The CSRR-loaded MIMO antenna system according to claim 8, wherein each of said patch antenna elements has dimensions of about $14\times11$ mm$^2$, spacing between said patch antenna elements in each of the pairs is about 5 mm, and radii of the outer rings of each said resonator is about 2.5 mm, whereby the CSRR-loaded MIMO antenna system is tuned for operation at about 5 GHz.

11. The CSRR-loaded MIMO antenna system according to claim 1, wherein said at least one pair of patch antenna elements consists of a two pairs of patch antenna elements, the transmission lines of one of the pairs of the patch antenna elements extending to a first edge of the PCB, the transmission lines of the other pair of the patch antenna elements extending to a second edge of the PCB 180° opposite the first edge, the two pairs of the patch antenna elements being disposed as symmetrical mirror images of each other on the PCB.

* * * * *